United States Patent [19]

Mount et al.

[11] Patent Number: 4,503,684

[45] Date of Patent: Mar. 12, 1985

[54] CONTROL APPARATUS FOR CENTRIFUGAL COMPRESSOR

[75] Inventors: Gordon L. Mount, West Monroe; Phiroze Bandukwalla, North Syracuse; Jarso Mulugeta, Dewitt, all of N.Y.

[73] Assignee: Carrier Corporation, Syracuse, N.Y.

[21] Appl. No.: 562,763

[22] Filed: Dec. 19, 1983

[51] Int. Cl.[3] ..... F25B 1/00

[52] U.S. Cl. ..... 62/115; 62/228.5; 418/47

[58] Field of Search ..... 62/226, 228.5, 115; 415/47–49; 418/44

[56] References Cited

U.S. PATENT DOCUMENTS

| | | | |
|---|---|---|---|
| 3,522,711 | 8/1970 | Shaughnessy | 62/226 X |
| 4,363,596 | 12/1982 | Watson et al. | 415/47 X |
| 4,460,310 | 7/1984 | Plunkett | 415/48 X |

*Primary Examiner*—William E. Wayner

*Attorney, Agent, or Firm*—Thomas J. Wall

[57] ABSTRACT

A centrifugal compressor having a variable wall diffuser section that is controlled in response to measured system parameters in order to maintain the compressor at optimum efficiency over extended operating range.

13 Claims, 4 Drawing Figures

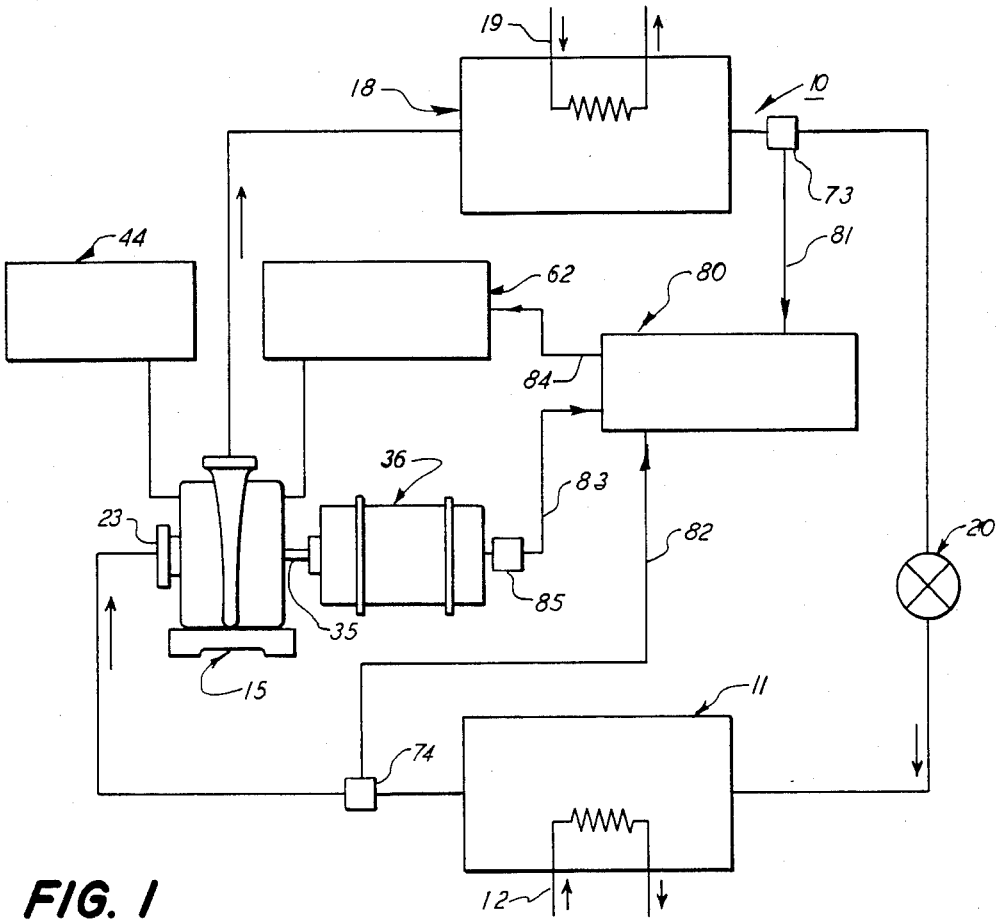
FIG. 1
FIG. 3
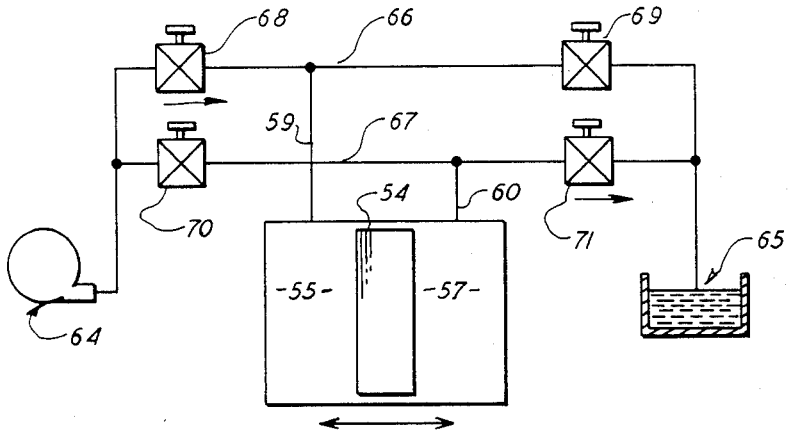

CONTROL APPARATUS FOR CENTRIFUGAL COMPRESSOR

BACKGROUND OF THE INVENTION

This invention relates to a centrifugal compressor and, in particular, to controlling the operation of a motor driven centrifugal compressor of the type used in refrigeration systems.

Most centrifugal compressors employed in refrigeration systems are arranged to turn at a fixed operating speed. Capacity control over the machine is normally accomplished by varying the position of a series of adjustable guide vanes located at the inlet of the machine. The mass rate of flow of refrigerant delivered to the impeller is thus varied to meet the changing load demands made on the machine. At maximum flow, the refrigerant leaving the impeller is more than the diffuser can handle and the flow becomes choked at the diffuser throat. At lower flow rates, on the other hand, the flow of refrigerant moving through the diffuser becomes unstable and a partial flow reversal takes place producing noise and a dramatic reduction in machine efficiency. Eventually a complete reversal in flow is experienced whereupon the compressor stalls or surges. The range between a choke condition and the onset of a surge condition generally defines the operating range of the machine. In a compressor relying solely upon the inlet guide vanes for capacity control, this range is extremely narrow, particularly when vanes are used in the diffuser.

Variable speed compressors wherein the speed of the impeller is varied to allow for changes in flow rates have been used with some success in the art. These variable speed machines, however, are very complex and thus expensive to build and operate. As a consequence they have not found wide general acceptance in the art and, in particular, the refrigeration industry.

Many schemes have been devised to increase the efficiency of centrifugal compressors. The use of vanes, both fixed and adjustable, in the diffuser section of the machine has proven to be very effective in this regard. In practice, however, fixed diffuser vanes severly limit the operating range. The operating range can be increased by using adjustable vanes. A diffuser section having adjustable vanes of this nature is shown in U.S. Pat. No. 3,957,392.

An even more successful approach towards improving both the efficiency and operating range of a centrifugal compressor is through the use of a variable width vaned diffuser. In this particular application, the diffuser contains a movable wall that can be selectively positioned in regard to a fixed wall to control the flow of refrigerant there between. A centrifugal compressor employing this moveable wall feature is disclosed in co-pending U.S. patent application Ser. No. 531, 019, filed Sept. 12, 1983, in the name of Kirtland. As disclosed by Kirtland, the inlet guide vanes of the compressor are used in a conventional manner to regulate the mass flow of refrigerant through the machine while the diffuser wall position is varied to prevent surging. No attempt is made by Kirtland, however, to correlate the inlet guide vane positioning with diffuser wall positioning. It has been found through tests, however, that although the variable wall vaned diffuser approach can improve both the surge margin and overall efficiency of the compressor, an arbitrary schedule of diffuser width versus guide vane angle results in relatively poor efficiency at the lower flow ranges.

SUMMARY OF THE INVENTION

It is therefore a primary object of this invention to improve centrifugal compressors used in refrigeration systems. It is a further object of the present invention to extend the effective operating range of a centrifugal compressor.

A still further object of the present invention to optimize the efficiency of a centrifugal compressor over a wide operating range without encountering surge.

Another object of the present invention is to improve the efficiency of a centrifugal compressor along a specific load line.

Yet another object of the present invention is to accurately position the wall of a variable width diffuser in response to measurable system parameters to ensure stability of the compressor and maximum operating efficiency over a wide range.

It is a still further object of the present invention to continually adjust the width of the diffuser section of a centrifugal compressor in response to measured load and flow conditions to hold the machine at an optimum operating point within a predetermined operating range.

These and other objects of the present invention are attained by means of a motor driven centrifugal compressor employed in a refrigeration system, said compressor including a variable width vaned or vaneless diffuser section having a movable wall, measuring means for determining the lift and the flow over the compressor, and a drive mechanism for positioning the movable diffuser in response to the measured lift and flow conditions to provide for maximum operating efficiency over an extended operating range.

BRIEF DESCRIPTION OF THE DRAWING

For a better understanding of these and other objects of the present invention, reference is had to the following detailed description of the invention which is to be read in conjunction with the accompanying drawings; wherein;

FIG. 1 is a schematic diagram showing a refrigeration system emboding the teachings of the present invention;

FIG. 3 is a schematic diagram showing a valve actuated hydraulic control unit for moving a drive piston used to accurately position the diffuser wall.

DESCRIPTION OF THE INVENTION

Figure 2:
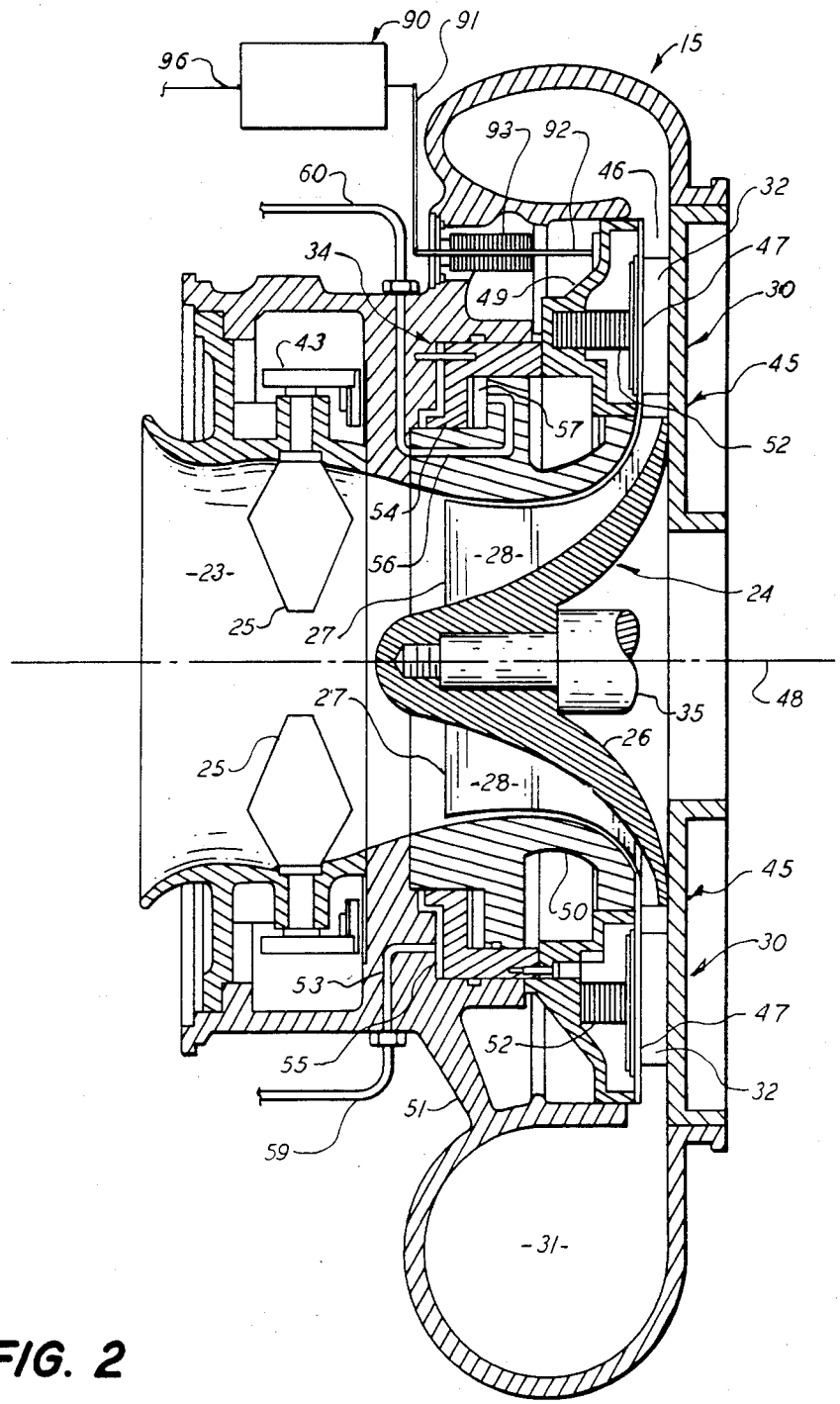
FIG. 2 is a sectional side elevation through the centrifugal compressor employed in the system illustrated in FIG. 1 further showing a variable width diffuser and its associated drive mechanism.

Turning now to the drawings, and specifically to FIG. 1, there is shown a refrigeration system generally referenced 10 for chilling a liquid within an evaporator heat exchanger 11. The substance to be chilled is circulated through the evaporator unit via a flow circuit 12 whereupon heat energy from the circulated substance is absorbed by the refrigerant thereby cooling the substance. Refrigerant vapors developed in the evaporator are drawn off by means of a centrifugal compressor, generally depicted at 15, which serves to pump the refrigerant to a higher temperature and pressure.

Slightly super-heated vapor leaving the compressor is passed through a condenser heat exchanger 18 where the superheat and latent heat is removed by cooling water passing through a flow circuit 19. The refrigerant leaving the condenser is flashed to a lower temperature by means of an expansion valve 20 before being passed to the inlet of the evaporator unit thereby completing the refrigeration loop.

The compressor 15 utilized in the present system is basically a single-stage machine, however, it should be obvious that multiple-stages may be utilized in the practice of the present invention without departing from the teachings contained herein. As disclosed in the co-pending Kirtland application, the compressor, as shown in FIG. 2, includes an axially aligned inlet 23 that directs incoming refrigerant into a rotating impeller wheel assembly 24 of conventional design through a series of adjustable inlet guide vanes 25—25. The impeller wheel includes a central hub 26 supporting a purality of blades 27—27 that cooperate to form passages 28—28 through the rotating assembly. Refrigerant moving through the blade passages is turned radially into a diffuser section generally referenced 30. The diffuser section surrounds the impeller wheel and serves to direct refrigerant into a toroidal-shaped volute or collector 31. Under the combined action of the diffuser and the volute, kinetic energy stored in the refrigerant is converted into static pressure. The hub 34 of the impeller wheel is connected to a drive shaft 35 which, in turn, is coupled to an electrical drive motor 36 (FIG. 1). As is typical in this type of application, the motor is adapted to drive the impeller at a constant operating speed.

Figure 4:
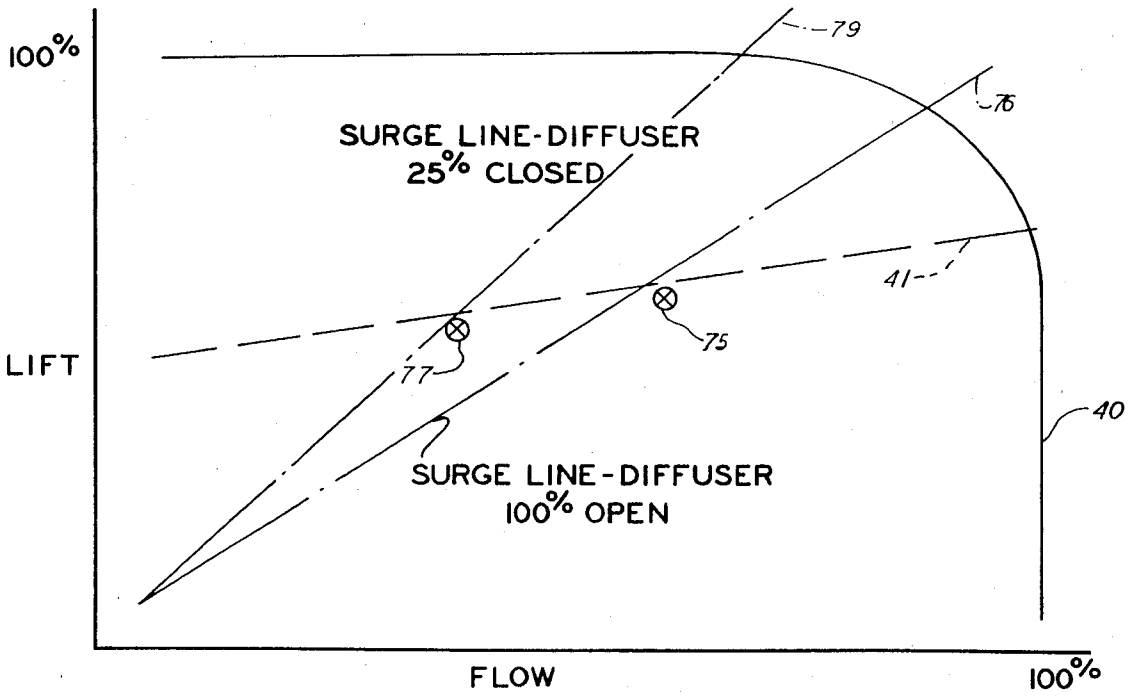
FIG. 4 is a graphic representation showing a compressor map for the present machine wherein lift is plotted against mass flow.

A compressor map, such as the map shown in FIG. 4 can be developed for the compressor 15 wherein lift is plotted against flow. The curve designated 40 represents the outer envelope of the compressor while dotted line 41 is a typical load line describing the machines operating characteristics for various inlet guide vane settings. A pully and cable mechanism 43 uniformly adjusts the position of each of the vanes in response to a control signal from the flow control unit 44 (FIG. 1) so as to regulate the flow of refrigerant through the machine. Any suitable guide vane control system as known and used in the art may be used in the practice of the present invention to vary the flow as described by the load line 41.

The diffuser section of the compressor contains a radially disposed stationary wall 45 that forms the back of the diffuser passage 46. A movable wall 47 forms the opposite or front part of the passage. The movable wall is also radially extended in regard to the center line 48 of the impeller wheel and is arranged to move axially towards and away from the fixed wall to alter the diffuser width. By varying the width of the diffuser, the flow of refrigerant through this critical section can be closely controlled to avoid surging at reduced flow rates and thus improve the operating efficiency of the machine. Furthermore, by continually tracking the lift and the flow of the compressor it is possible to hold the machine at as optimum operating point close to the surge line without encountering stall.

The movable front wall of the diffuser section is secured to a generally annular carriage 49 that is slidably contained in the compressor between the shroud 50 and the main machine casing 51. Although not shown, the movable wall is secured to the carriage by any suitable means so that the two members move in concert towards and away from the fixed wall 45 of the diffuser. A series of diffuser vanes 32—32 pass through the movable wall and are held in biasing contact against the fixed wall by means of springs 52—52. The carriage illustrated in FIG. 2 is fully retracted against the machine casing to bring the diffuser to a 100% open condition.

The carriage is, in turn, secured to a double acting piston 54 by screws or the like. The piston is reciprocally supported in a chamber 34 formed between the shroud and the machine casing so that it can be driven axially in either direction. A first flow passage 53 is arranged to bring hydraulic fluid into and out of the front section 55 of the chamber. A second flow passage 56 is similarly arranged to carry fluid into and out of the rear section 57 of the chamber. A pair of control lines 59 and 60 operatively connect the two flow passages with a wall control unit 62 (FIG. 1). Hydraulic fluid is selectively exchanged between the control unit and the chamber to drive the piston and thus the movable diffuser wall in a desired direction.

The wall control unit 62 is shown in greater detail in FIG. 3 and includes a pump 64 and a hydraulic sump 65 that are inter-connected by means of two flow lines 66 and 67. Flow line 66 contains a pair of electrically operated solinoid valves 68 and 69 while flow line 67 contains a similar pair of valves 70 and 71. By electrically controlling the positioning of the valves hydraulic fluid can be fed into one side of the piston chamber while being simultaneously exhaused from the opposite side thereof. To initiate travel of the piston in either direction requires energization (opening) of one pair of the four valves. For example, as illustrated in FIG. 3 by the arrows, energizing valve pair 68 and 71 will cause hydraulic fluid to be fed via line 59 into the front section of the piston chamber and fluid in the back side of the chamber to be exhaused to the sump 65 via line 60. This in turn drives the piston towards a wall closing direction. Energization of the opposing pair of valves 69 and 70 will cause the wall to be moved back towards a fully open position.

Through proper sequencing of the valves in the wall control unit, the movable wall can be brought to any desired position within its operating range. With further reference to FIG. 4, the wall is normally maintained at a fully opened position at high flow rates. As the inlet guide vanes are closed to restrict the incoming refrigerant flow, the operating point of the machine approaches a surge condition. This point is depicted at point 75 on the map. Further closure of the guide vanes will bring the machine into a surge condition whereupon flow through the fully opened diffuser will become unstable.

The onset of a surge condition is detected in the present system by monitoring certain key system parameters indicative of lift and flow. This information is fed to a microprocessor 80 that is programmed, as will be explained in greater detail below, to track lift and flow conditions and to continually reposition the diffuser wall to avoid surge. The microprocessor is connected to the wall control unit and is adapted to sequence the valve pairs to bring the wall to the required position. The microprocessor is further programmed to hold the operating point of the compressor as close to surge as possible without entering surge in order to optimize the compressor efficiency.

As shown graphically in FIG. 4, the movable diffuser wall is held at the 100% open position where the compressor is operating in the upper flow range. The surge line for a fully opened wall position is shown at 76 on the map. When the operating point of the machine moves close to the surge line, as for example at point 75, the programable microprocessor senses the impending onset of surge and instructs the wall control unit to move the wall to a more restricted position. Repositioning the wall in this manner reduces the diffuser width and shifts the surge line back to a new position thus extending the effective operating range of the machine. Surge line 79 depicts the surge region when the wall is moved to a 25% closed position. As can be seen, following the same load line, the machine can be brought to a second operating point 77 without encountering surge. As the operating point moves from point 75 to point 77, the microprocesser continually track the changing load and flow conditions and hold the wall position slightly ahead of the operating point to insure that optimum operating efficiency is maintained over the entire diffuser range.

Returning once again to FIG. 1, temperature sensors 73 and 74 are placed in the refrigerant lines leaving the evaporator unit and the condensor unit. Saturated temperature information of the leaving refrigerant is continually fed to the microprocesser via data lines 81 and 82. Similarly, the compressor motor is equipped with an ampere monitor 85 that provides amperage information to the microprocesser via a third data line 83. The information furnished to the microprocesser is used to determine both lift and flow so that the operating point of the machine on the compressor map can be continually tracked.

The position of the movable diffuser wall 47 is monitored by a potentiometer 90 (FIG. 2). A sensing rod 92 is passed through a bellows 93 which is adapted to ride in biasing contact against the carriage so that as the carriage moves in and out the rod will continually sense its position. The rod communicates with the potentiometer via an arm 91 whereupon the output of the potentiometer changes in accordance with changes in the wall position. This data is sent to the microprocessor via data line 96 to provide the processor with exact wall position information.

Using this information, the desired width of the diffuser passage can be determined for providing optimum efficiency and the wall control unit instructed via control line 85 to bring the wall to this particular setting. As noted above, capacity control is achieved in the present compressor by conventional movable inlet guide vanes while the diffuser passage width is varied in order to optimize efficiency at reduced flow rates. The diffuser passage width is varied according to the following relationship:

$$\%\ \text{WIDTH} = 100\left[\frac{C_1\,(\%\ AMPS - C_2)}{(\text{LIFT} - C_2)}\right] C_3$$

where:

percent width is the relative width of the diffuser passage and 100 signified maximum passage opening;

percent amps represents the measured compressor motor current flow as a percent of its full rated capacity;

Lift is the lift on the compressor in units of degrees Fahrenheit based on the measured saturated refrigerant temperature in the condensor and evaporator units; and $C_1$, $C_2$, and $C_3$ are all constants.

Lift is calculated using the following relationship:

LIFT=(T) DIA. MULT.

where:

T is the temperature difference in degrees Fahrenheit between the refrigerant leaving the evaporator unit and that leaving the condensor unit;

DIA. MULT. is a multiplier for adjusting the calculated compressor lift based upon impellor diameter.

In the event the calculated diffuser width turns out to be greater than 100, indicating that the machine is operating in the higher flow ranges, the processor is programmed to instruct the wall control unit to move the wall to a fully-opened position and hold the wall in this position until such time as the flow moves back into the lower range. At that time, based on information furnished to the microprocessor, the wall unit valves are instructed to move the piston, and thus the diffuser wall, to a new more restricted position so as to maintain the operating point of the machine close to the surge point. This insures optimum running efficiency for the machine at the lower flow rates. Correspondingly, as the flow is increased, the wall is moved in the opposite direction until it once again reaches a fully-opened position.

It should now be evident, the apparatus of the present invention is capable of continually tracking the operating point of the compressor upon the compressor map and adjusting the diffuser wall in response thereto to hold the compressor at optimum efficiency over an extremely wide range while still avoiding a surge condition.

While this invention has been disclosed with specific reference to the details as set forth above, it is not intended to be limited to the specific structure and the invention is intended to cover any modifications or changes that may come within the scope of the following claims.

We claim:

1. A method of controlling a motor driven centrifugal compressor used in a refrigeration system that includes the steps of providing a diffuser section in the compressor having a movable wall for varying the width of the diffuser and thereby change the compressors surge point within a predetermined operating range, measuring both the lift and the flow of the compressor, defining the optimum position of the movable diffuser wall at the measured lift and flow for providing maximum operating efficiency without the compressor surging, and moving the diffuser wall to the optimum position.

2. The method of claim 1 wherein the compressor lift is measured by finding the difference between the saturated refrigerant temperature in the condenser and that in the evaporator.

3. The method of claim 1 wherein the compressor flow is measured by measuring the current flow through the compressor motor and relating the current flow to the measured lift.

4. The method of claim 3 wherein the diffuser width is varied in accordance with the following relationship:

$$\% \text{ WIDTH} = 100\left[\frac{C_1(\% AMPS - C_2)}{(\text{LIFT} - C_2)}\right] C_3$$

where:

% width is the relative width of the diffuser opening and 100 signifies maximum width, % AMPS is the compressor motor current as a percent of its rated full load capacity, Lift is in degrees Fahrenheit based on the saturation temperatures of the evaporator and condenser units, $C_1$, $C_2$ and $C_3$ are all constants.

5. The method of claim 1 that includes the further step of attaching the movable wall of the diffuser to a double acting piston contained in a chamber and driving the piston within the chamber to move the attached wall toward and away from an opposed fixed wall.

6. The method of claim 5 that includes the further step of driving the double acting piston in either direction by introducing fluid under pressure into one side of the piston chamber and exhausting fluid from the other side of said chamber.

7. The method of claim 6 that further includes the step of controlling the flow of fluid into and out of said chamber in response to the proximity of the operating point of the compressor to the surge point.

8. The method of claim 1 that includes the further step of regulating the flow of refrigerant through the compressor by adjusting the positioning of a series of inlet guide vanes.

9. Apparatus for preventing a motor driven compressor used in a refrigeration system from surging that includes a diffuser section in the compressor having a movable wall arranged to move toward and away from an opposed fixed wall to vary the width of the diffuser passage whereby the surge point of the compressor can be changed within a predetermined operating range, control means for positioning said movable wall in response to an input control signal, measuring means for monitoring system parameters indicative of both compressor lift and flow and providing data output signals relating thereof, and programable means for receiving said data signals and providing a control signal for moving said wall to an optimum position for the measured lift and flow to provide for maximum operating efficiency without the compressor surging.

10. The apparatus of claim 9 wherein said programable means is a microprocessor.

11. The apparatus of claim 10 wherein said control means includes a cylinder containing a drive piston attached to the movable wall, and a series of electrically activated valves that are responsive to the output of the microprocessor to selectively route fluid to either side of the cylinder where by the wall can be moved toward and away from said fixed wall.

12. The apparatus of claim 11 wherein said measuring means includes temperature sensing means for measuring the saturated temperature difference between the system condenser and the system evaporator and current sensing means for measuring the flow of current through the compressor motor.

13. The apparatus of claim 12 wherein programable means varies the diffuser width in accordance with the relationship:

$$\% \text{ WIDTH} = 100\left[\frac{C_1(\% AMPS - C_2)}{(\text{LIFT} - C_2)}\right] C_3$$

where:

% width is the relative width of the diffuser opening and 100 signifies maximum width, % AMPS is the compressor motor current as a percent of its rated full load capacity, Lift is in degrees Fahrenheit based on the saturation temperatures of the evaporator and condenser units, $C_1$, $C_2$ and $C_3$ are all constants.

* * * * *